US011457707B2

(12) United States Patent
Hofstrand

(10) Patent No.: US 11,457,707 B2
(45) Date of Patent: Oct. 4, 2022

(54) EARBUD CASE WITH ROTATING LATCH

(71) Applicant: NLU Products, L.L.C., Lehi, UT (US)

(72) Inventor: Ryan Hunter Hofstrand, Saratoga Springs, UT (US)

(73) Assignee: NLU PRODUCTS, L.L.C., Lehi, UT (US)

( * ) Notice: Subject to any disclaimer, the term of this patent is extended or adjusted under 35 U.S.C. 154(b) by 16 days.

(21) Appl. No.: 17/148,199

(22) Filed: Jan. 13, 2021

(65) Prior Publication Data

US 2022/0218081 A1 Jul. 14, 2022

(51) Int. Cl.

| | |
|---|---|
| ***A45C 11/00*** | (2006.01) |
| ***A45C 13/00*** | (2006.01) |
| ***H04R 1/10*** | (2006.01) |
| ***H04R 1/02*** | (2006.01) |
| ***A45C 13/02*** | (2006.01) |

(52) U.S. Cl.

CPC ..... *A45C 11/00* (2013.01); *A45C 13/005* (2013.01); *A45C 13/02* (2013.01); *H04R 1/02* (2013.01); *H04R 1/1025* (2013.01); *A45C 2011/001* (2013.01)

(58) Field of Classification Search

CPC ..... A45C 11/00; A45C 13/00; A45C 13/005; A45C 13/02; A45C 2011/001; H04R 1/02; H04R 1/025; H04R 1/10; H04R 1/1091; H04R 1/1025

USPC ..... 206/320; 220/244, 315, 319, 322

See application file for complete search history.

(56) References Cited

U.S. PATENT DOCUMENTS

| | | | | |
|---|---|---|---|---|
| 1,522,633 | A | 1/1925 | Kister | |
| D148,402 | S | 1/1946 | Abbatiello | |
| 3,530,778 | A * | 9/1970 | Finelli | G03B 17/02 220/315 |
| 5,029,724 | A * | 7/1991 | Serio | B65D 55/14 292/205 |
| 6,733,053 | B2 | 5/2004 | Hodge et al. | |
| 10,287,095 | B2 | 5/2019 | Reeb et al. | |
| D893,184 | S | 8/2020 | Liu | |
| D897,678 | S | 10/2020 | Koh | |
| D897,997 | S | 10/2020 | Zhang | |

(Continued)

FOREIGN PATENT DOCUMENTS

| | | | |
|---|---|---|---|
| CN | 208939608 | U | 6/2019 |
| FR | 3094973 | A1 | 10/2020 |

(Continued)

OTHER PUBLICATIONS

US International Searching Authority; International Search Report and Written Opinion for Application No. PCT/US22/11934 dated Mar. 29, 2022.

*Primary Examiner* — Bryon P Gehman

(74) *Attorney, Agent, or Firm* — Parsons Behle & Latimer

(57) ABSTRACT

An earbud storage apparatus may include a main body configured to receive a set of earbuds therein. The apparatus may further include a lid configured to enclose the earbuds within the main body, where a profile of the lid includes a circular arc. The apparatus may also include a bar attached to the main body, where the bar is rotatable between a first position and a second position relative to the main body about a rotation axis, and where a surface of the bar that faces the rotation axis is adjacent to and moves along the circular arc of the profile of the lid during rotation of the bar.

20 Claims, 6 Drawing Sheets

(56) References Cited

U.S. PATENT DOCUMENTS

| | | | | |
|---|---|---|---|---|
| D898,664 | S | 10/2020 | Bhutani | |
| 11,172,101 | B1 * | 11/2021 | Boozer | H04N 5/23241 |
| 2017/0094392 | A1 | 3/2017 | Zorkendorfer et al. | |
| 2021/0029424 | A1 * | 1/2021 | Wright | H04R 1/1025 |
| 2021/0085047 | A1 * | 3/2021 | Wright | A45C 11/00 |
| 2021/0274275 | A1 * | 9/2021 | Daniels | H04R 1/1091 |

FOREIGN PATENT DOCUMENTS

| | | | | |
|---|---|---|---|---|
| WO | WO-2020253181 | A1 | * | 12/2020 |
| WO | WO2020253181 | A1 | | 12/2020 |

* cited by examiner

EARBUD CASE WITH ROTATING LATCH

FIELD OF THE DISCLOSURE

This disclosure is generally related to the field of enclosures and cases and, in particular, to an earbud case with a rotating latch.

BACKGROUND

Earbud cases may have lids that encloses earbuds within a case. In some cases, the lid may be connected to a main body of the case via a hinge or a similar mechanism. In other cases, the lid may be removable, or the earbud case may include two separable parts. Other alternatives may exist. When closed, the lid may help retain the earbuds. Because they are typically meant to be mobile, earbud cases may be put in bags or pockets. While being carried, they may be jostled, or otherwise subjected to small or large impacts. In some cases, they may even be inadvertently dropped. Upon impact, a lid on a typical earbud case may become disengaged from the case and the contents of the case (e.g., a set of earbuds) may be spilled out and could sustain damage.

While some earbud cases may include nub-and-indent-type latches, spring-loaded lids, or other types of mechanisms for holding the lids in place, a sufficient shock or constant jostling may nevertheless cause the lid to open. Further, users may use earbud case lids for fidgeting, repeatedly opening and closing them. This activity can loosen the lids, making it easier to inadvertently open them. Other disadvantages may exist.

SUMMARY

Disclosed herein is an earbud case having a latch bar that prevents a lid from opening even when the latch bar is not fully engaged in a locked position. The earbud case may also provide a user with a fidget toy to help prevent usage of the lid itself for fidgeting, thereby preventing undue wear of the earbud case.

In an embodiment, an earbud storage apparatus includes a main body configured to receive a set of earbuds therein. The apparatus further includes a lid configured to enclose the earbuds within the main body, where a profile of the lid includes a circular arc. The apparatus also includes a bar attached to the main body, where the bar is rotatable between a first position and a second position relative to the main body about a rotation axis, and where a surface of the bar that faces the rotation axis is adjacent to and moves along the circular arc of the profile of the lid during rotation of the bar.

In some embodiments, the lid is movable relative to the main body while the bar is in the first position. In some embodiments, the lid is immovable relative to the main body while the bar is in the second position. In some embodiments, the lid is immovable relative to the main body while the bar is in a range of positions between the first position and the second position. In some embodiments, the bar has a u-shape, and the bar is attached to the main body at two points on the rotation axis. In some embodiments, a surface of the lid includes a spherical lune, where the circular arc runs along the spherical lune, and where the surface of the bar that faces the rotation axis is adjacent to and moves along the spherical lune during rotation of the bar. In some embodiments, the apparatus includes a universal serial bus port that enables charging of the earbuds while the earbuds are positioned in the main body. In some embodiments, the apparatus includes an attachment loop positioned on the main body, wherein the attachment loop is configured to attach to a keychain, a lanyard, a carabiner, or a hand strap. In some embodiments, the apparatus includes a lip or a recessed cutout formed onto the lid to assist a user with moving the lid.

In an embodiment, a method of forming an earbud storage apparatus includes attaching a lid to a main body, where the main body is configured to receive a set of earbuds therein, where the lid is configured to enclose the earbuds within the main body, and where a profile of the lid includes a circular arc. The method further includes attaching a bar to the main body, where the bar is rotatable between a first position and a second position relative to the main body about a rotation axis, and where a surface of the bar that faces the rotation axis is adjacent to and moves along the circular arc of the profile of the lid during rotation of the bar.

In some embodiments, the lid is movable relative to the main body while the bar is in the first position. In some embodiments, the lid is immovable relative to the main body while the bar is in the second position. In some embodiments, the lid is immovable relative to the main body while the bar is in a range of positions between the first position and the second position. In some embodiments, the bar has a U-shape, and attaching the bar includes attaching the bar to the main body at two points on the rotation axis. In some embodiments, a surface of the lid includes a spherical lune, where the circular arc runs along the spherical lune, and where the surface of the bar that faces the rotation axis is adjacent to and moves along the spherical lune during rotation of the bar. In some embodiments, the method includes attaching a universal serial bus port to the main body that enables charging of the earbuds while the earbuds are positioned in the main body. In some embodiments, the method includes forming an attachment loop on the main body, where the attachment loop is configured to attach to a keychain, a lanyard, a carabiner, or a hand strap. In some embodiments, the method includes forming a lip or a recessed cutout onto the lid to assist a user with moving the lid.

In an embodiment, a storage apparatus includes a main body having a cavity defined therein. The apparatus further includes a lid configured to enclose the cavity within the main body, where a surface of the lid includes a spherical lune. The apparatus also includes a bar attached to the main body, where the bar is rotatable between a first position and a second position relative to the main body about a rotation axis, and where a surface of the bar that faces the rotation axis is adjacent to and moves along the spherical lune during rotation of the bar.

In some embodiments, the lid is movable relative to the main body while the bar is in the first position, and the lid is immovable relative to the main body while the bar is in a range of positions between the first position and the second position.

Figure 1:
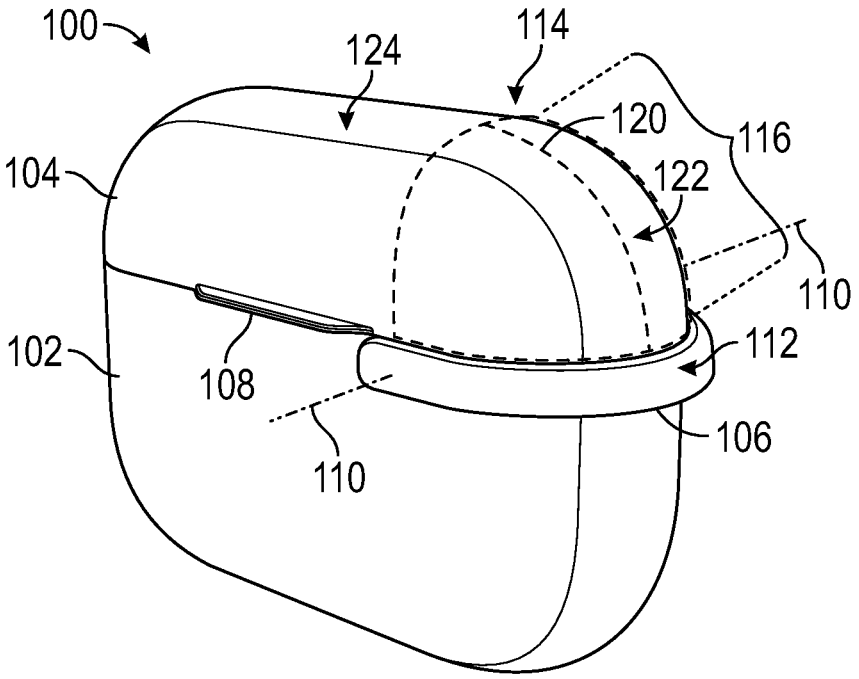
FIG. 1 is a perspective view of an embodiment of an earbud storage apparatus having a bar in a first position.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure.

DETAILED DESCRIPTION

Referring to FIG. 1, a perspective view of an embodiment of an earbud storage apparatus 100 is depicted. The apparatus 100 may include a main body 102, a lid 104, and a rotatable bar 106. The lid 104 may include a lip 108 to facilitate opening the earbud storage apparatus 100. In some cases, the lid may swing open along a hinge (not shown in FIG. 1) to enable insertion and/or removal of earbuds from the main body 102.

The rotatable bar 106 may rotate along a rotation axis 110, which is shown as a dash-dotted line. The rotatable bar 106 may pass between a first position 112 and a second position 114. In FIG. 1, the rotatable bar 106 is depicted in the first position 112. A range of positions 116 may exist between the first position 112 and the second position 114. While in the first position 112, the bar 106 may be out of the way of the lid 104 such that it does not restrict movement of the lid 104. However, while in the second position 114, or even in the range of positions 116, the bar 106 may restrict movement of the lid 104 and prevent it from moving, or otherwise opening.

The lid 104 may have a curved top surface 124. A profile of the curved top surface 124 of the lid 104 may include a circular arc 120 (which may be viewed more clearly in FIG. 2). As shown in FIG. 1, the curved top surface 124 of the lid 104 may also include a spherical lune 122. The circular arc 120 and the spherical lune 122 are shown by dashed lines. The curved top surface 124 may also include a symmetrical surface on the other side of the lid 104. However, other shapes are possible.

Figure 2:
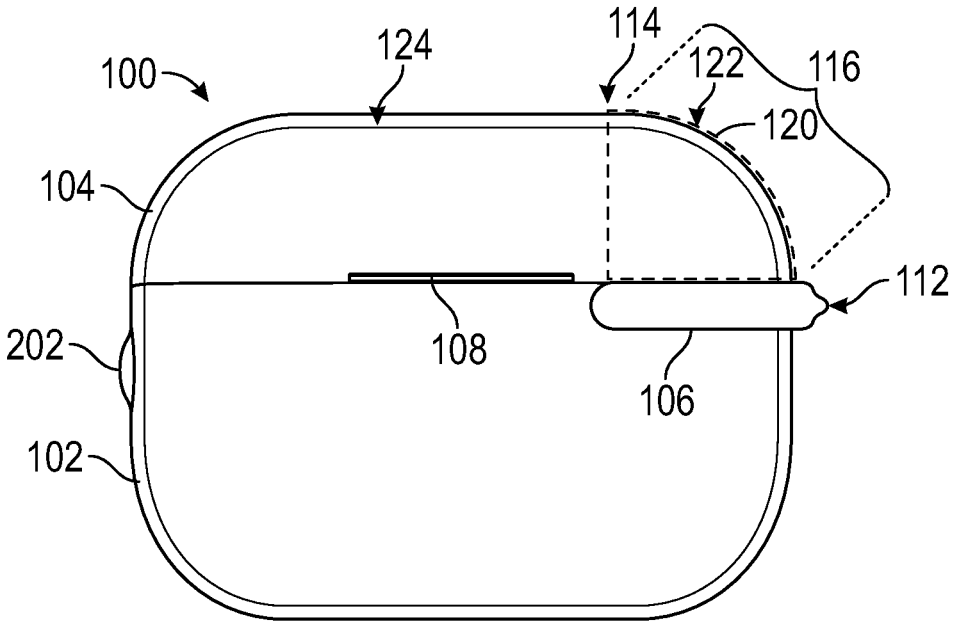
FIG. 2 is a front view of an embodiment of an earbud storage apparatus having a bar in a first position.

Referring to FIG. 2, a front view of the earbud storage apparatus 100 is depicted. From the front view, a profile of the curved top surface 124 may be visible, including the circular arc 120, which may run along the spherical lune 122. The bar 106 may be positioned adjacent to the circular arc 120 and may follow along the circular arc 120 as it rotates. By following the circular arc 120, the bar 106 may be adjacent to, and may retain, the lid 104 regardless of whether it is within the second position 114 or within the range of positions 116. When the bar 106 is moved to all the way into the first position 112, the lid 104 may be released from the main body 102 of the apparatus 100.

FIG. 2 also provides an additional view of the lip 108, which may be used to lift the lid 104. Further, an attachment loop 202 may be positioned on a side of the main body 102 for attachment of a keychain, a lanyard, a carabiner, a hand strap, or another type of carrying or gripping device.

Figure 3:
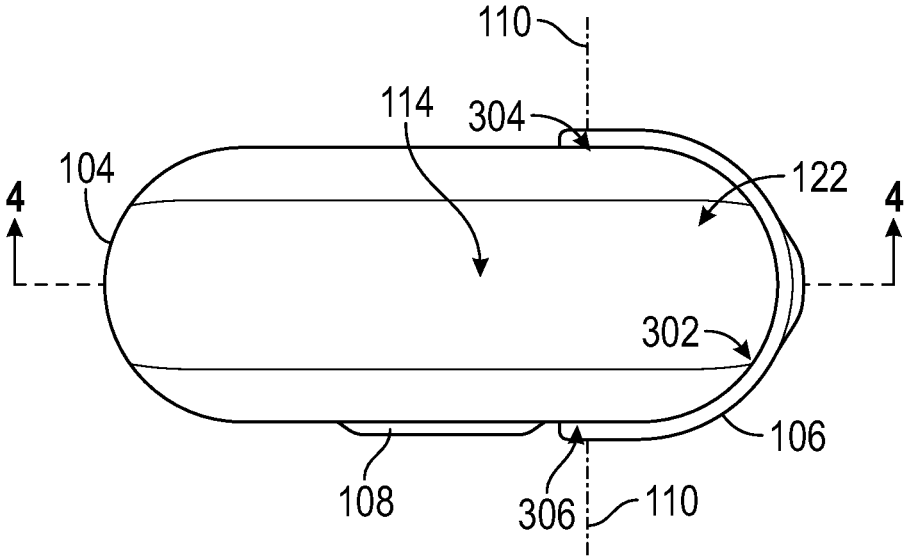
FIG. 3 is a top view of an embodiment of an earbud storage apparatus.

Referring to FIG. 3, a top view of the earbud storage apparatus 100 is depicted. As shown, the bar 106 may be attached to the main body 102 (not visible in FIG. 3) at a first point 304 and a second point 306 along the rotation axis 110. The bar 106 may have a U-shape. A surface 302 in the interior of the bar 106 may face the rotation axis 110. Because of the U-shape, the surface 302 may be adjacent along the full width of the spherical lune 122 as the bar 106 rotates over the lid 104. This may provide added security in retaining the lid 104 even while the bar 106 is not fully rotated to the second position 114. As used herein, adjacent means that the surface 302 is close enough to the spherical lune 122 to lock the lid 104 in place, preventing its removal or rotation, even if not in direct contact with the spherical lune 122. For example, in practice a space may be provided between the surface 302 and the spherical lune 122 to facilitate rotation of the bar 106. Also shown in FIG. 3, the lip 108 may jut partially out from the lid 104 to facilitate lifting and/or rotation of the lid 104 when it is not locked by the bar 106.

Figure 4:
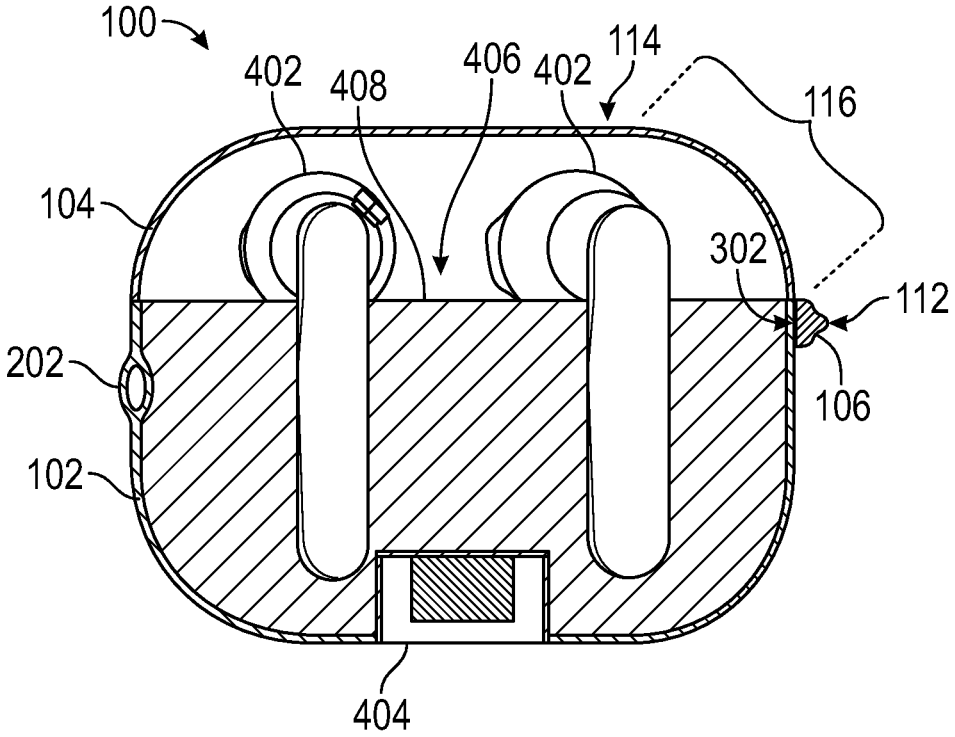
FIG. 4 is a cross-section view of an embodiment of an earbud storage apparatus.

Referring to FIG. 4, a cross-section view of the earbud storage apparatus 100 is provided along the cross-section line 4-4 in FIG. 3. For clarity, some details of the insides of the main body 102 (including electrical components) are shown as a solid holding structure 408 in FIG. 4. It should be understood that the apparatus 100 may nevertheless include additional features that are not shown, such as charging circuitry, protective structuring, etc. A set of earbuds 402 are depicted as being enclosed within the main body 102 of the apparatus 100 by the lid 104. For clarity, the earbuds 402 are not shown in cross-section.

The main body 102 of the apparatus 100 may have a cavity 406 defined therein. In other words, the main body 102 may be a shell that at least partially encloses the cavity 406. The lid 104 may enclose the cavity 406 within the main body 102 while it is closed and may enable access to the cavity 406 when it is open. In that way, the apparatus 100 may store and protect the earbuds 402. The bar 106 is depicted in the first position 112. As can be seen in FIG. 4, the lid 104 is not retained by the bar 106 in the first position 112. As the bar 106 rotates through the range of positions 116 and while the bar 106 is in the second position 114, the surface 302 of the bar 106 may hold and retain the lid 104.

FIG. 4 also shows some additional features of the apparatus 100. For example, in the bottom of the apparatus 100, a universal serial bus ("USB") interface 404 may provide charging power, and/or other functionality, to the apparatus 100. Other types of electrical interfaces may also be used. FIG. 4 also provides a view of the attachment loop 202. Other features, not shown in FIGS. 1-4 may also be included. For example, the apparatus 100 may include cutouts for speaker ports, lights for user interfaces, other user utility and accessibility options, or combinations thereof.

Figure 5:
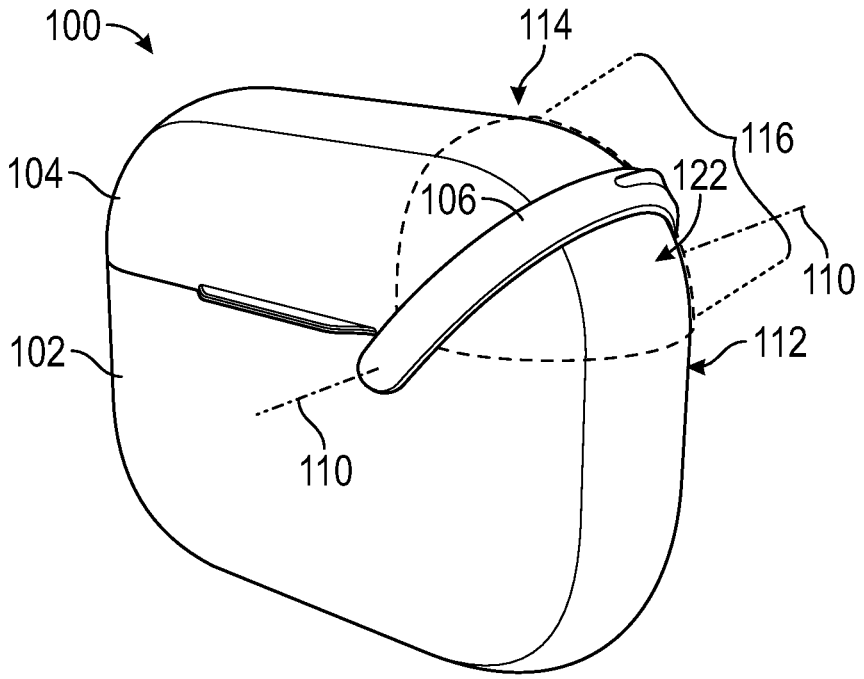
FIG. 5 is a perspective view of an embodiment of an earbud storage apparatus having a bar between a first position and a second position.
Figure 6:
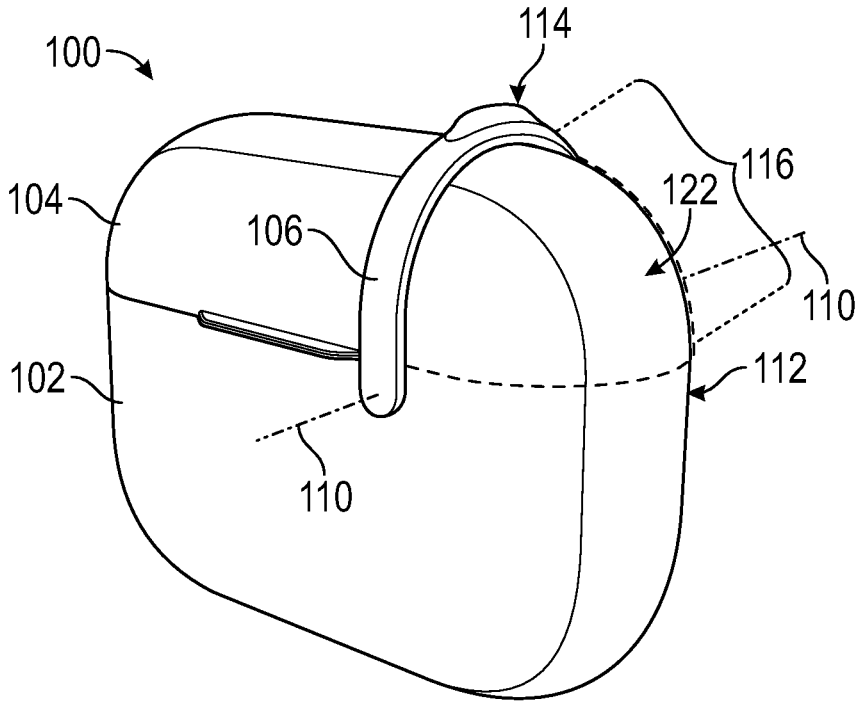
FIG. 6 is a perspective view of an embodiment of an earbud storage apparatus having a bar in a second position.
Figure 7:
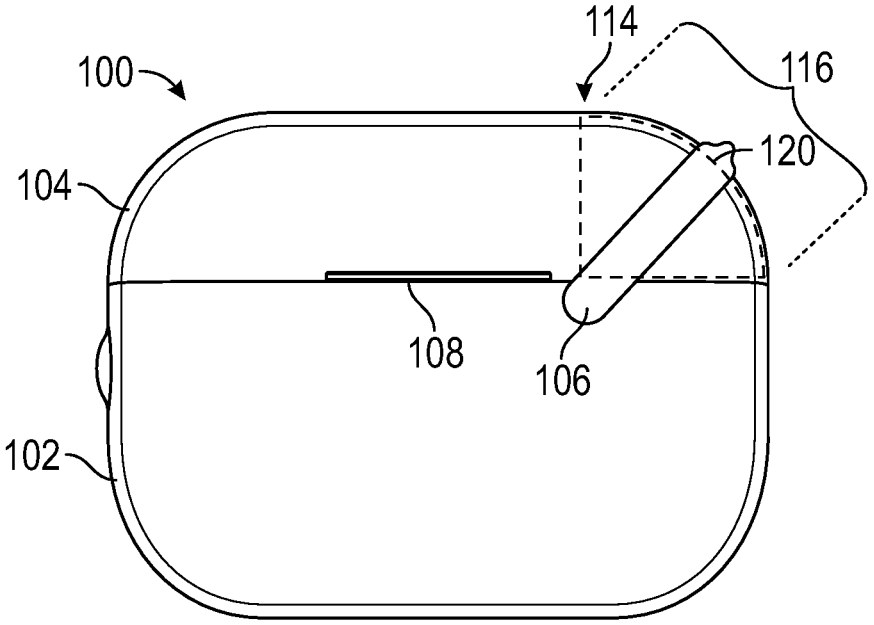
FIG. 7 is a front view of an embodiment of an earbud storage apparatus having a bar between a first position and a second position.
Figure 8:
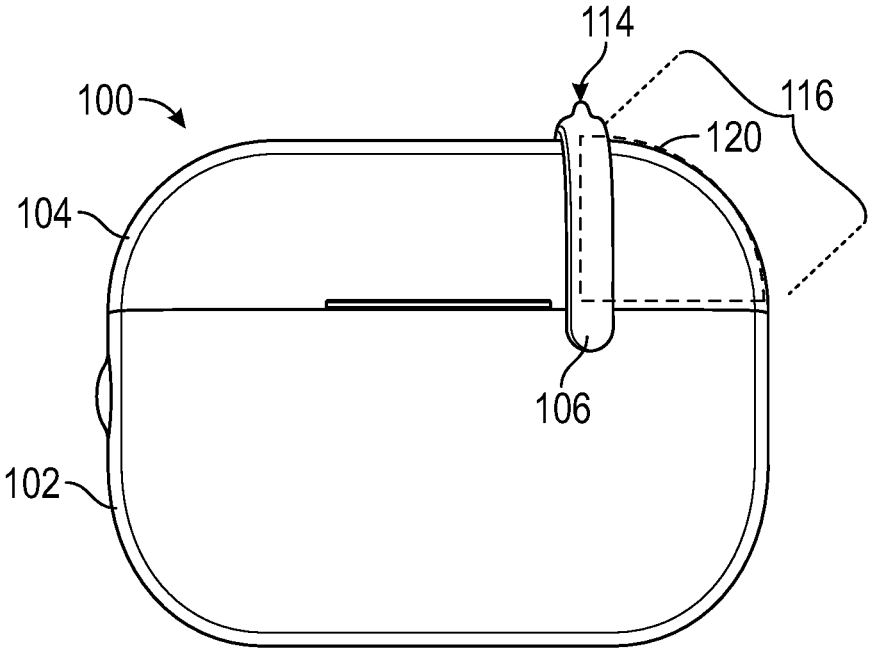
FIG. 8 is a front view of an embodiment of an earbud storage apparatus having a bar in a second position.

Referring to FIG. 5, the apparatus 100 is depicted with the bar 106 falling within the range of position 116. As seen in FIG. 5, the bar 106 may lock the lid 104 relative to the main body 102 while in the range of positions 116 even though it is not fully rotated to the second position 114. Referring to FIG. 6, the apparatus 100 is depicted with the bar 106 full rotated to the second position 114. In FIGS. 5 and 6, as the bar 106 rotates around the rotation axis 110, an inner surface of the bar 106 (not visible in FIGS. 5 and 6) is adjacent to and moves along the spherical lune 122. Likewise, referring to FIGS. 7 and 8, the apparatus 100 is depicted with the bar 106 falling within the range of position 116 (FIG. 7) and with the bar 106 being at the second position 114 (FIG. 8). As the bar 106 rotates it remains adjacent to and moves along the circular arc 120. This enables the bar 106 to retain the lid 104 relative to the main body 102 even if the bar 106 is not full rotated to the second position 114.

Figure 9:
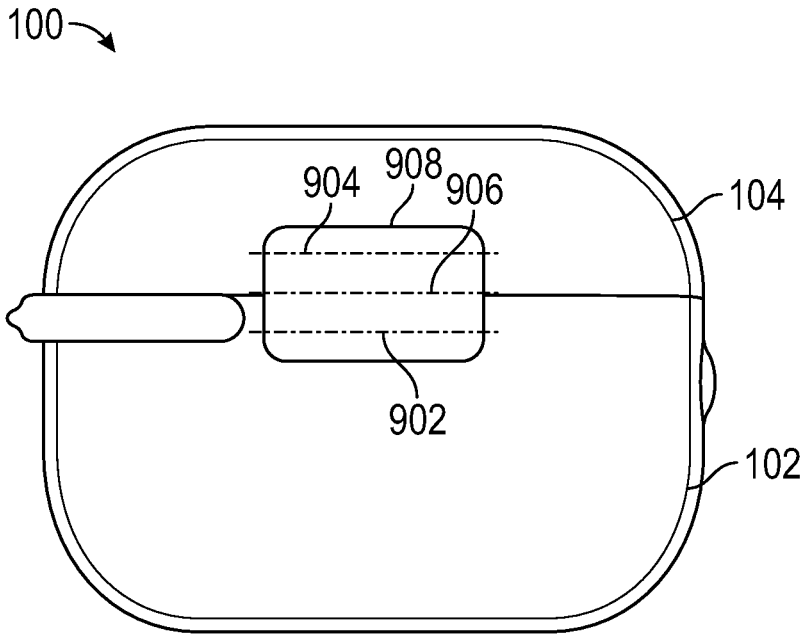
FIG. 9 is a backside view of an embodiment of an earbud storage apparatus.

Referring to FIG. 9, a back view of the apparatus 100 is depicted. As shown in FIG. 9, the lid 104 may be attached to the main body 102 along a lid attachment axis 906. As an alternative, the lid 104 may also be attached to the main body 102 via an intermediate hinge piece 908. The intermediate hinge piece 908 may rotate relative to the main body 102 along a first lid attachment axis 902 and the lid 104 may rotate relative to the intermediate hinge piece 908 along a second lid attachment axis 904. This may provide a more ergonomic method for opening the lid 104. Thus, the lid attachment axes 902, 904 may be optional alternatives to the lid attachment axis 906.

Figure 10:
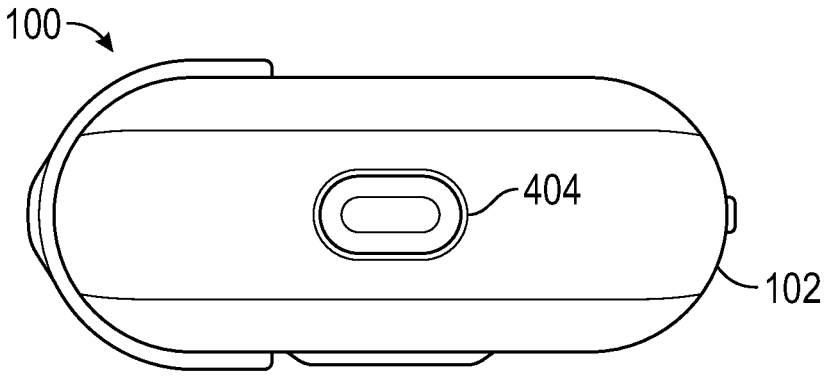
FIG. 10 is a bottom view of an embodiment of an earbud storage apparatus.

Referring to FIG. 10, a bottom view of the apparatus 100 is depicted. From the bottom, the USB interface 404 is clearly depicted within the main body 102 of the apparatus 100. As stated before, other power/signal interfaces are also possible.

A benefit associated with the apparatus 100 is that the lid may be held securely by the bar. Another benefit is that by being adjacent to and following the curvature of the circular arc, the bar may prevent the lid from opening even when not fully engaged in the second position. Further, by being adjacent to and following the spherical lune, the bar may have more contact with the lid, further securing it, even when not fully engaged in the second position. In this way, the apparatus may prevent inadvertently opening the apparatus. Another benefit is that the bar may provide a user with a fidget toy. For example, earbud cases may have a size and shape that are convenient to hold, and the bar may provide a user something to play with while otherwise resting idle. For example, a user can continuously move the bar between the first position and the second position while waiting in line, sitting at a bus stop, watching a show or movie, or while in other similarly idle situations. Other benefits may exist.

Figure 11:
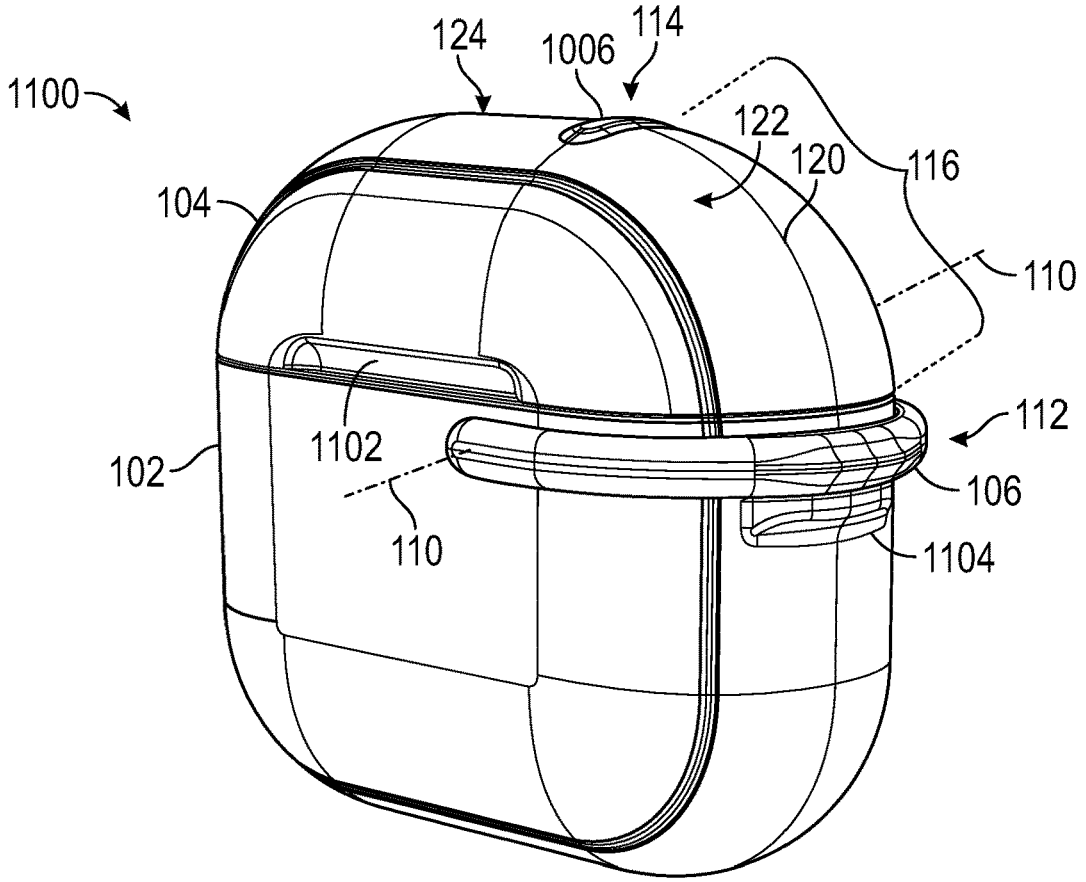
FIG. 11 is a perspective view of an alternate embodiment of an earbud storage apparatus.

Referring to FIG. 11, an alternate embodiment of an earbud storage apparatus 1100 is depicted. The apparatus 1100 may include a main body 102, a lid 104, and a bar 106 similar to the apparatus 100. As with the apparatus 100, the bar 106 may be rotatable about a rotation axis 110 from a first position 112 to a second position 114 through a range of positions 116. Further, the bar 106 may be adjacent to and follow a circular arc 120 and a spherical lune 122 along a portion of a surface 124 of the lid 104 as described with reference to the apparatus 100. Therefore, as with the apparatus 100, the lid 104 of the apparatus 1100 may be held securely by the bar 106.

The apparatus 1100 may further include a recessed cutout 1102 (instead of a lip as described with respect to the apparatus 100). The recessed cutout 1102 may facilitated moving the lid 104. The apparatus 1100 may also include a ledge 1104 for receiving the bar 106 thereon. The ledge 1104 may provide structural stability for the bar 106 and prevent over-rotation. A structure 1106 at the position 114 may provide an indent-nub-type snap connection to hold the bar 106 in place while in the second position 1106. Although not visible in FIG. 11, a similar structure may exist at the first position 112.

As can be deduced from FIG. 11, multiple embodiments may exist having various shapes and features in addition to the bar 106. This disclosure in intended to include all such variations.

Figure 12:
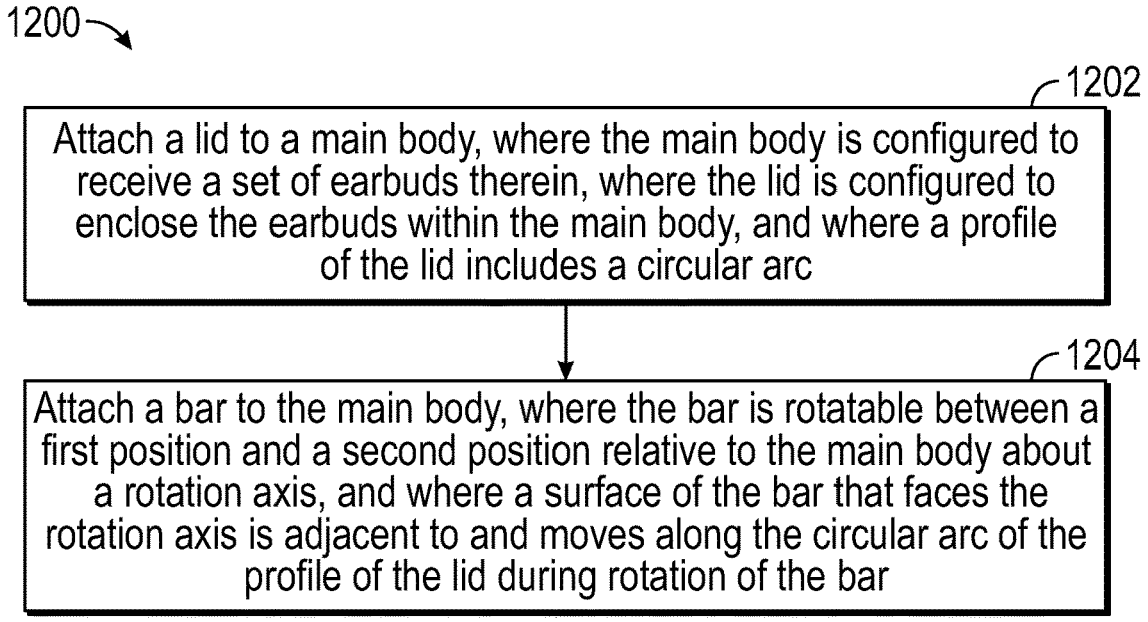
FIG. 12 is a flow chart depicting an embodiment of a method for forming an earbud storage apparatus.

Referring to FIG. 12, an embodiment of a method 1200 for forming an earbud storage apparatus is depicted. The method 1200 may include attaching a lid to a main body, where the main body is configured to receive a set of earbuds therein, where the lid is configured to enclose the earbuds within the main body, and where a profile of the lid includes a circular arc, at 1202.

The method 1200 may further include attaching a bar to the main body, where the bar is rotatable between a first position and a second position relative to the main body about a rotation axis, and where a surface of the bar that faces the rotation axis is adjacent to and moves along the circular arc of the profile of the lid during rotation of the bar, at 1204.

A benefit associated with the method 1200 is that a storage apparatus may be formed where a lid of the apparatus may be held securely by a bar. Another benefit is that by being adjacent to and following the curvature of the circular arc, the bar may prevent the lid from opening even when not fully engaged in the second position. Other benefits may exist.

Although various embodiments have been shown and described, the present disclosure is not so limited and will be understood to include all such modifications and variations as would be apparent to one skilled in the art.

What is claimed is:

1. An earbud storage apparatus comprising:

a main body configured to receive a set of earbuds therein;

a lid configured to enclose the earbuds within the main body, wherein a profile of the lid includes a circular arc; and a bar attached to the main body, wherein the bar is rotatable between a first position and a second position relative to the main body about a rotation axis, the rotation axis perpendicular to the profile that includes the circular arc, and wherein a surface of the bar that faces the rotation axis is adjacent to and moves along the circular arc of the profile of the lid during rotation of the bar.

2. The apparatus of claim 1, wherein the lid is movable relative to the main body while the bar is in the first position.

3. The apparatus of claim 1, wherein the lid is immovable relative to the main body while the bar is in the second position.

4. The apparatus of claim 1, wherein the lid is immovable relative to the main body while the bar is in a range of positions between the first position and the second position.

5. The apparatus of claim 1, wherein the bar has a u-shape, and wherein the bar is attached to the main body at two points on the rotation axis.

6. The apparatus of claim 1, wherein a surface of the lid includes a spherical lune, wherein the circular arc runs along the spherical lune, and wherein the surface of the bar that faces the rotation axis is adjacent to and moves along the spherical lune during rotation of the bar.

7. The apparatus of claim 1, further comprising a universal serial bus port that enables charging of the earbuds while the earbuds are positioned in the main body.

8. The apparatus of claim 1, further comprising an attachment loop positioned on the main body, wherein the attachment loop is configured to attach to a keychain, a lanyard, a carabiner, or a hand strap.

9. The apparatus of claim 1, further comprising a lip or a recessed cutout formed onto the lid to assist a user with moving the lid.

10. A method of forming an earbud storage apparatus comprising:

attaching a lid to a main body, wherein the main body is configured to receive a set of earbuds therein, wherein the lid is configured to enclose the earbuds within the main body, and wherein a profile of the lid includes a circular arc; and attaching a bar to the main body, wherein the bar is rotatable between a first position and a second position relative to the main body about a rotation axis, and wherein a surface of the bar that faces the rotation axis is adjacent to and moves along the circular arc of the profile of the lid during rotation of the bar, and wherein the surface of the bar that faces the rotation axis is equidistant to the circular arc at multiple points of rotation along the circular arc.

11. The method of claim 10, wherein the lid is movable relative to the main body while the bar is in the first position.

12. The method of claim 10, wherein the lid is immovable relative to the main body while the bar is in the second position.

13. The method of claim 10, wherein the lid is immovable relative to the main body while the bar is in a range of positions between the first position and the second position.

14. The method of claim 10, wherein the bar has a u-shape, and wherein attaching the bar includes attaching the bar to the main body at two points on the rotation axis.

15. The method of claim 10, wherein a surface of the lid includes a spherical lune, wherein the circular arc runs along the spherical lune, and wherein the surface of the bar that faces the rotation axis is adjacent to and moves along the spherical lune during rotation of the bar.

16. The method of claim 10, further comprising attaching a universal serial bus port to the main body that enables charging of the earbuds while the earbuds are positioned in the main body.

17. The method of claim 10, further comprising forming an attachment loop on the main body, wherein the attachment loop is configured to attach to a keychain, a lanyard, a carabiner, or a hand strap.

18. The method of claim 10, further comprising forming a lip or a recessed cutout onto the lid to assist a user with moving the lid.

19. A storage apparatus comprising:

a main body having a cavity defined therein;

a lid configured to enclose the cavity within the main body, wherein a surface of the lid includes a spherical lune; and a bar attached to the main body, wherein the bar is rotatable between a first position and a second position relative to the main body about a rotation axis, and wherein a surface of the bar that faces the rotation axis is adjacent to and moves along the spherical lune during rotation of the bar.

20. The apparatus of claim 19, wherein the lid is movable relative to the main body while the bar is in the first position, and wherein the lid is immovable relative to the main body while the bar is in a range of positions between the first position and the second position.

* * * * *